US008517683B2

(12) United States Patent
Miocevich

(10) Patent No.: US 8,517,683 B2
(45) Date of Patent: Aug. 27, 2013

(54) MARINE PROPELLER PITCH ADJUSTMENT MEANS

(75) Inventor: John Bradley Miocevich, Canning Vale (AU)

(73) Assignee: Veem Engineering Group Pty Ltd., Canning Vale (AU)

( * ) Notice: Subject to any disclaimer, the term of this patent is extended or adjusted under 35 U.S.C. 154(b) by 868 days.

(21) Appl. No.: 12/526,176

(22) PCT Filed: Feb. 8, 2008

(86) PCT No.: PCT/AU2008/000162

§ 371 (c)(1),
(2), (4) Date: Oct. 1, 2009

(87) PCT Pub. No.: WO2008/095259

PCT Pub. Date: Aug. 14, 2008

(65) Prior Publication Data

US 2010/0008780 A1 Jan. 14, 2010

(30) Foreign Application Priority Data

Feb. 8, 2007 (AU) ..... 2007900622

(51) Int. Cl.
*B63H 1/26* (2006.01)
*B63H 3/00* (2006.01)

(52) U.S. Cl.
USPC ..... 416/62; 416/224; 416/236 R

(58) Field of Classification Search
USPC ..... 416/62, 224, 236 R, 146 R
See application file for complete search history.

(56) References Cited

U.S. PATENT DOCUMENTS

| | | | | |
|---|---|---|---|---|
| 1,446,011 | A | 2/1923 | Jackson | |
| 2,099,229 | A | 11/1937 | Possenheim | |
| 2,498,170 | A | 2/1950 | Meier | |
| 2,978,040 | A | 4/1961 | Wirkkala | |
| 2,990,889 | A | 7/1961 | Welch | |
| 3,812,812 | A | 5/1974 | Hurwitz | |
| 4,047,835 | A | 9/1977 | Hornung | |
| 5,791,874 | A | 8/1998 | Lang | |
| 6,467,422 | B1 * | 10/2002 | Elms | 114/274 |
| 2005/0233654 | A1 * | 10/2005 | Mueller | 440/49 |

FOREIGN PATENT DOCUMENTS

| | | |
|---|---|---|
| GB | 496700 | 12/1938 |

* cited by examiner

*Primary Examiner* — Edward Look
*Assistant Examiner* — Jesse Prager
(74) *Attorney, Agent, or Firm* — Volpe and Koenig, P.C.

(57) ABSTRACT

A blade for a marine propeller includes an adjustment strip located in a channel near the trailing edge of a high pressure face of the blade. The adjustment strip protrudes from the blade face, altering the hydrodynamic properties of the blade. Strips can be replaced with other strips of different heights in order to suit particular requirements for hydrodynamic properties.

20 Claims, 5 Drawing Sheets

MARINE PROPELLER PITCH ADJUSTMENT MEANS

FIELD OF THE INVENTION

The present invention relates to a means for adjusting the hydrodynamic properties, such as the pitch, of a marine propeller.

BACKGROUND TO THE INVENTION

Propulsion systems for marine vessels are typically calibrated to operate within narrow parameters in order to achieve efficient operation. In particular, the hydrodynamic properties of a marine propeller are generally closely matched to the speed and power of an associated motor; the weight, weight distribution and hull resistance of the vessel; and the environment, such as the water temperature, within which the vessel operates.

Many engines for use within marine vessels are electronically controlled to adjust their power output depending on the ambient air and water temperatures within which the vessel is operating. This can make choice of a propeller difficult, as it is important that the propeller be designed such that a minimum speed of revolution is reached when the engine throttle is completely opened, in order to prevent overloading of the engine.

The complexities of propeller design are further exacerbated by the prospect that the speed of rotation of the propeller will vary depending on the extent of sheet cavitation. The amount of cavitation varies considerably according to the speed of the vessel, the density and temperature of the water within which the propeller is working, as well as the hydrodynamic properties of the hull and shaft line. Cavitation can result in excessive vibration, wear and loss of efficiency of a propeller.

Although complex, the hydrodynamic properties of propellers are sufficiently well understood that it is possible to design a propeller to match the known characteristics of a marine vessel and engine. Problems arise, however, when characteristics of a vessel are changed, for instance by the addition of new features such as a fishing tower, or by the relocation of the vessel from a cold water environment to a warm water environment.

Known solutions for this problem range from the replacement of the propeller—which can be a very expensive procedure—to manual bending of the propeller blades. Bending of the blades alters the propeller's hydrodynamic properties in substantially uncontrollable ways, and also introduces stresses which can lead to fatigue cracking and ultimate mechanical failure of the blades.

The present invention seeks to at least partially ameliorate these problems, and to provide a means for altering the hydrodynamic properties of a marine propeller in a controlled manner.

SUMMARY OF THE PRESENT INVENTION

In accordance with one aspect of the present invention there is provided a blade for a marine propeller, the blade including an attachment portion arranged to receive an adjustment means, whereby engagement of an adjustment means with the attachment portion alters the hydrodynamic properties of the blade. The present invention envisages a selection of adjustment means being available, whereby a particular one of more of the adjustment means may be chosen achieved desired hydrodynamic properties.

In accordance with a second aspect of the present invention there is provided an adjustment means arranged to engage with a blade of a marine propeller, the adjustment means having an engaging portion arranged to be received by an attachment portion of a blade, whereby engagement of the adjustment means with a blade alters the hydrodynamic properties of the blade.

Preferably the attachment portion comprises a channel within the blade, and the adjustment means comprises a strip receivable within the channel, the strip including a portion which juts outwardly. Advantageously, the strip may be readily removed and interchanged.

More preferably, the channel is located adjacent to a trailing edge of the blade, on a high pressure face. Advantageously, this allows for the use of strips to alter the effective pitch of the propeller. It is desirable that the strip be located as close as possible to the trailing edge without introducing stress concentrations within the blade. This is preferably within 50 mm of the trailing edge, and may be about 15 mm from the trailing edge.

The width of the strip may be less than 10 mm, perhaps about 5 mm. This provides sufficient strip strength without greatly altering blade properties.

The length of the strip may be about 60% of the blade radius. Having the strip extend beyond 90% of the blade radius, and providing a concave curve at its end, allows for a useful localised increase in water pressure at this end. Have the strip commence from about 30% of the blade radius minimises losses due to water flow internally of the strip.

In an alternative embodiment, the strip may be located on the low pressure face of the blade. It is envisaged that this will help in prevention of cavitation.

BRIEF DESCRIPTION OF THE DRAWINGS

It will be convenient to further describe the invention with reference to the accompanying drawings which illustrate preferred embodiments of the propeller adjustment of the present invention. Other embodiments are possible, and consequently, the particularity of the accompanying drawings is not to be understood as superseding the generality of the preceding description of the invention. In the drawings.

DESCRIPTION OF PREFERRED EMBODIMENTS

Figure 1:
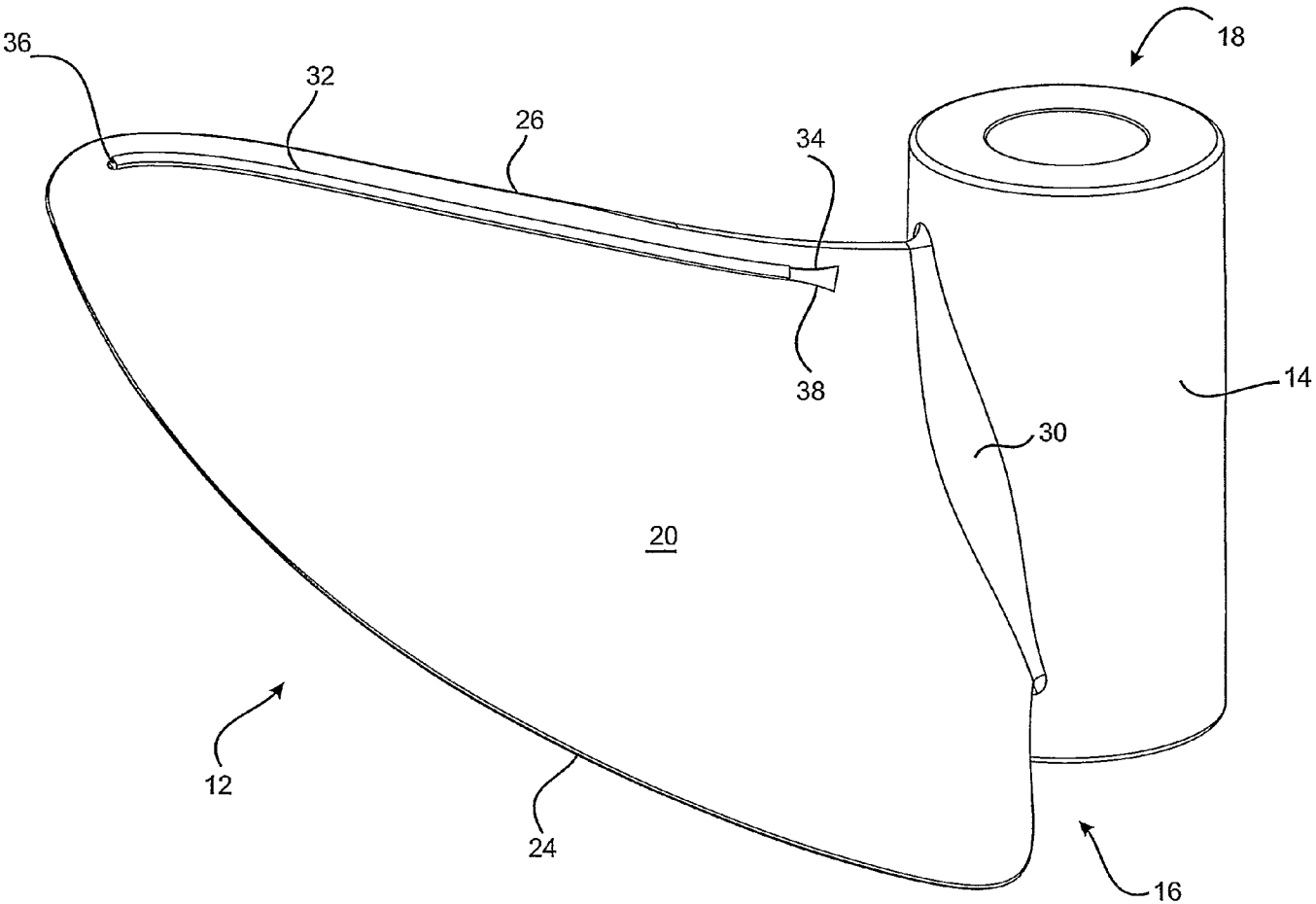
FIG. 1 is a perspective of a marine propeller blade in accordance with the present invention.

Referring to the figures, there is shown a single blade 12 of a propeller 10. The propeller 10 has a plurality of such blades 12 extending outwardly from a hub 14. Typically, a propeller 10 may have five or six blades 12, however it will be appreciated that the present invention may be applied to propellers having any desired number of blades.

The propeller 10 has a low-pressure or upstream side 16 and a high pressure or downstream side 18.

The blades 12 are all substantially similar in shape and configuration. Each blade 12 has a high pressure face 20 substantially oriented towards the downstream side 18 of the propeller 10, and a low pressure face 22 substantially oriented towards the upstream side 16 of the propeller 10. Each blade 12 has a leading edge 24, a trailing edge 26, and an inner edge 30. The inner edge 30 of each blade 12 is joined to the hub 14. The leading edge 24 forms a convex curve extending from the inner edge 30 to an outermost part of the propeller 10. In the embodiment of the drawings the trailing edge 26 forms a generally concave curve from the inner edge 30 to the outermost part of the propeller. The curvature of the leading edge 24 is significantly greater than that of the trailing edge 26, thus defining a bulbous shape for the faces 20, 22 of the blade.

Figure 2:
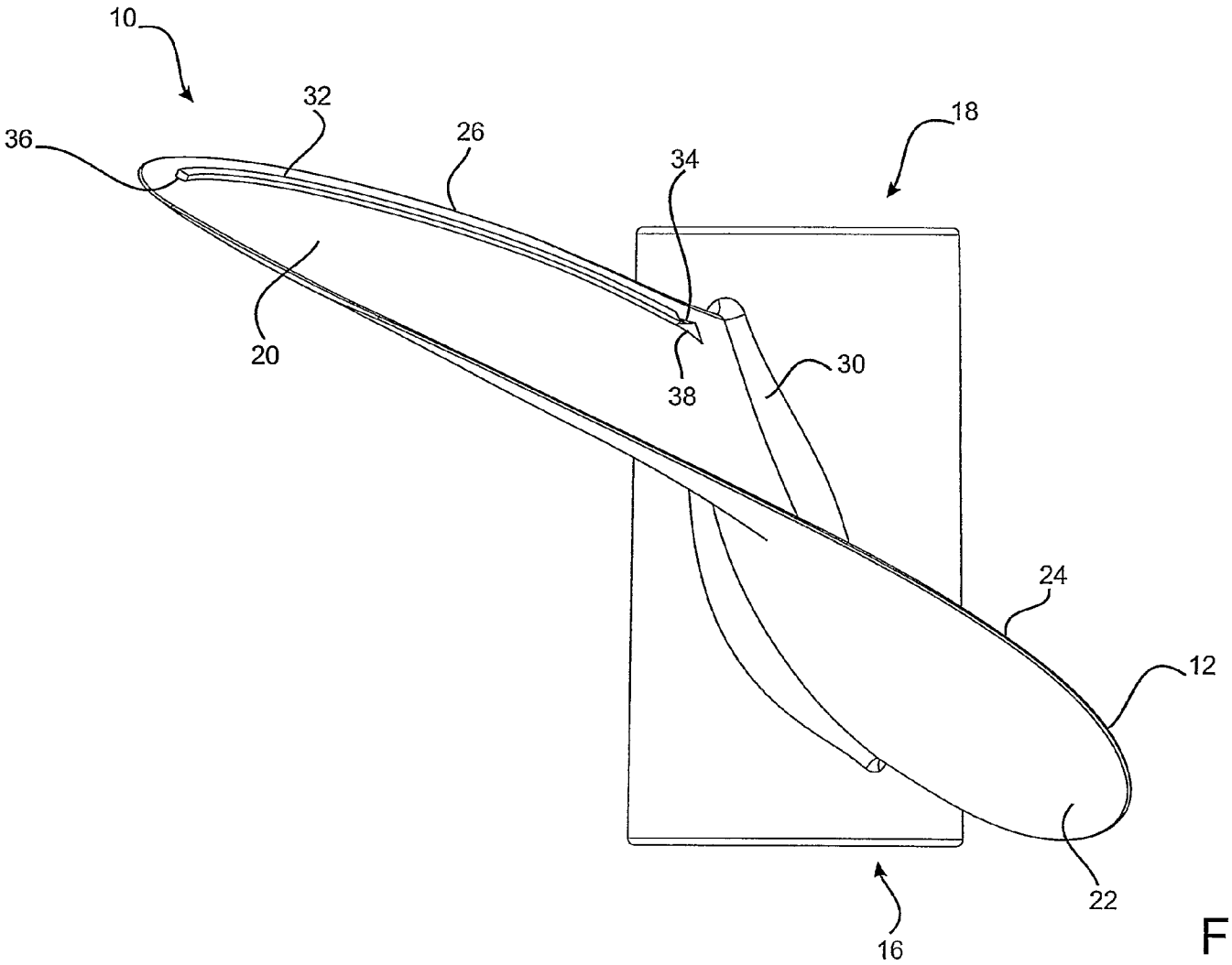
FIG. 2 is a side view of the propeller blade of FIG. 1.
Figure 3:
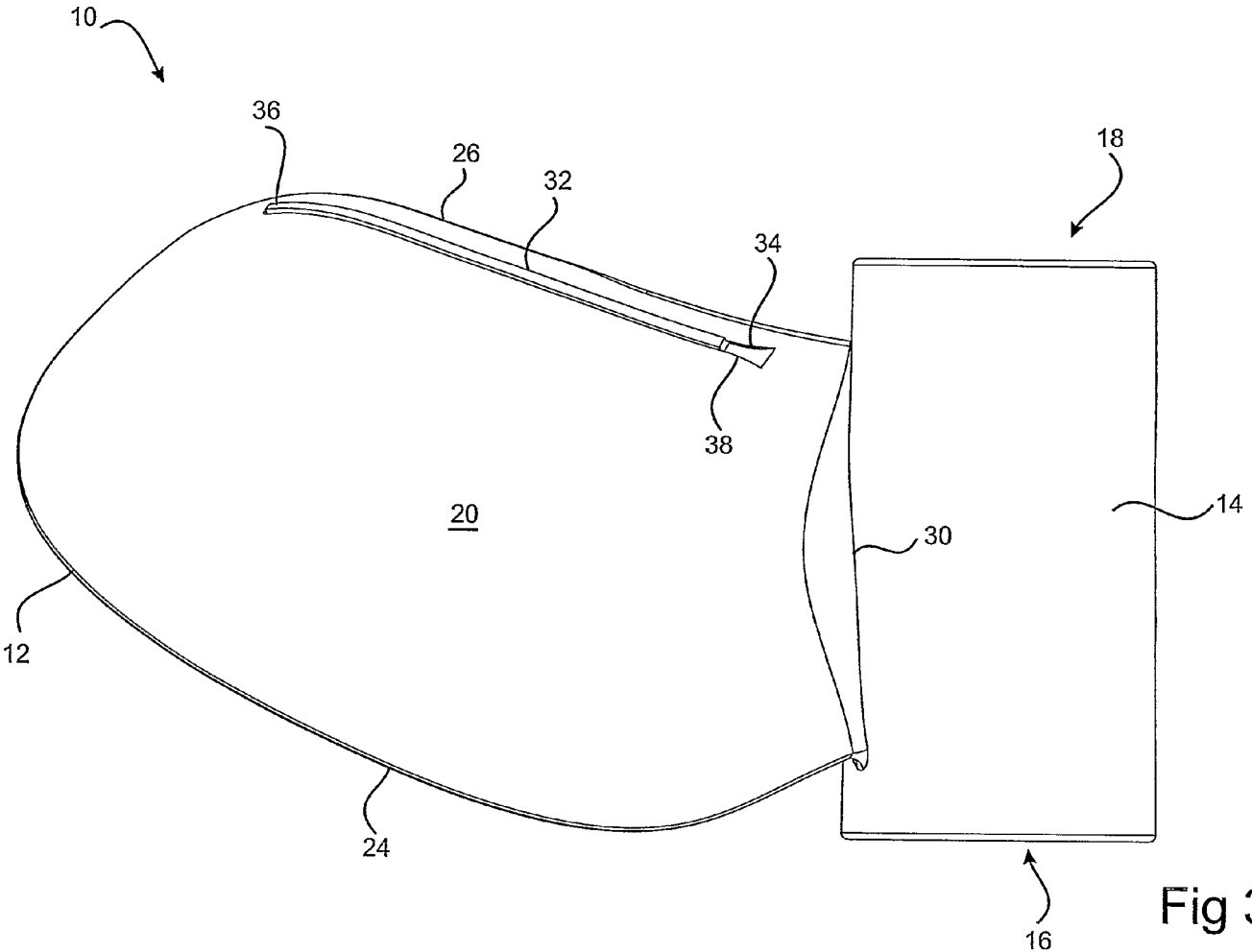
FIG. 3 is a front view of the propeller blade of FIG. 1.
Figure 5:
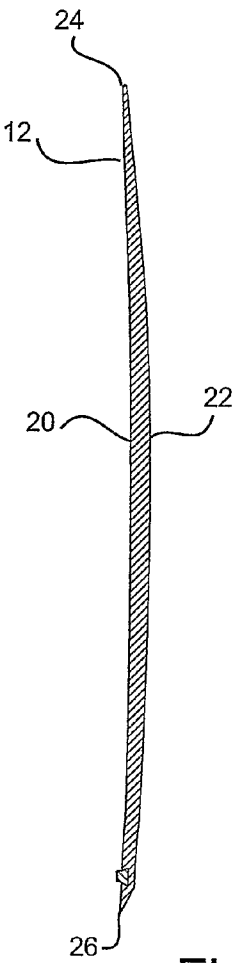
FIG. 5 is a cross section, through the chord A-A marked in FIG. 4, of the propeller blade of FIG. 1.
Figure 4:
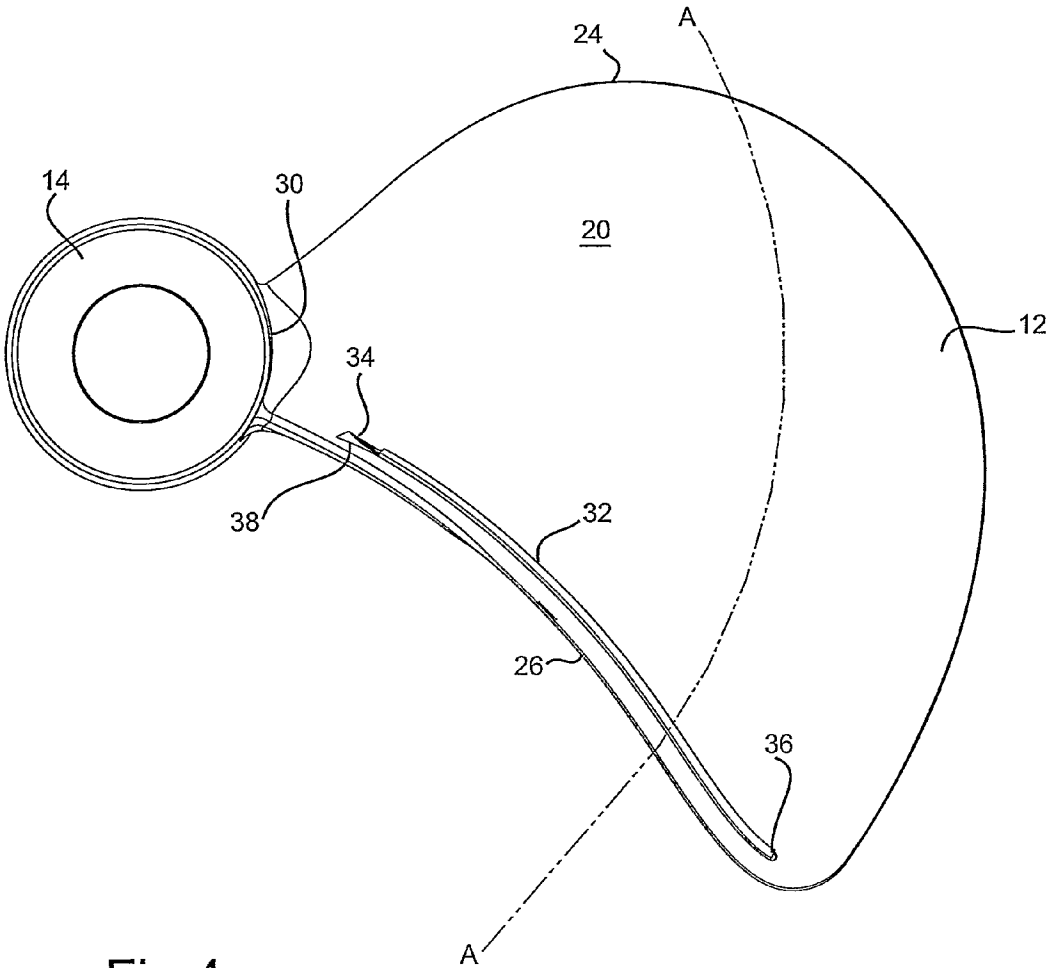
FIG. 4 is an end view of the propeller blade of FIG. 1.

In the embodiment shown in the drawings, each blade 12 curves away from the hub 14, as best seen in FIG. 2. The inner edge 30 is oriented relatively along the hub 14, making a blade angle relative to a longitudinal direction of the hub 14. The blade angle will vary with distance from the boss and nominal design pitch. At its most curved outer portion, the leading edge 24 makes an angle of about 65° relative to a longitudinal direction of the hub 14.

It will be appreciated that all parameters of the propeller 10 as above described are substantially set during casting of the propeller. As such, they may be chosen and engineered to suit a particular application.

The advantage of the present invention lies in the ability to modify the properties of the propeller without changing the engineered shape and configuration.

Each blade 12 includes an attachment portion in the form of a channel 32. In a preferred embodiment, as shown in the drawings, the channel 32 is located on the high pressure face 20 of the blade adjacent to, but slightly spaced from, the trailing edge 26. In the embodiment of the drawings the channel extends from a first end 34, near the inner edge 30, to a second end 36, near the outermost end of the trailing edge 26. The channel 32 substantially follows the contour of the trailing edge 26. In particular, the channel 32 has a concave curve at its outer end 36, following the contour of the trailing edge 26 as it meets the leading edge 24.

In the preferred embodiment shown in the drawings, the first end 34 is located at a point with a radial distance about 0.3 of the propeller radius. The second end 36 is located at a point with a radial distance about 0.925 of the propeller radius.

Figure 6:
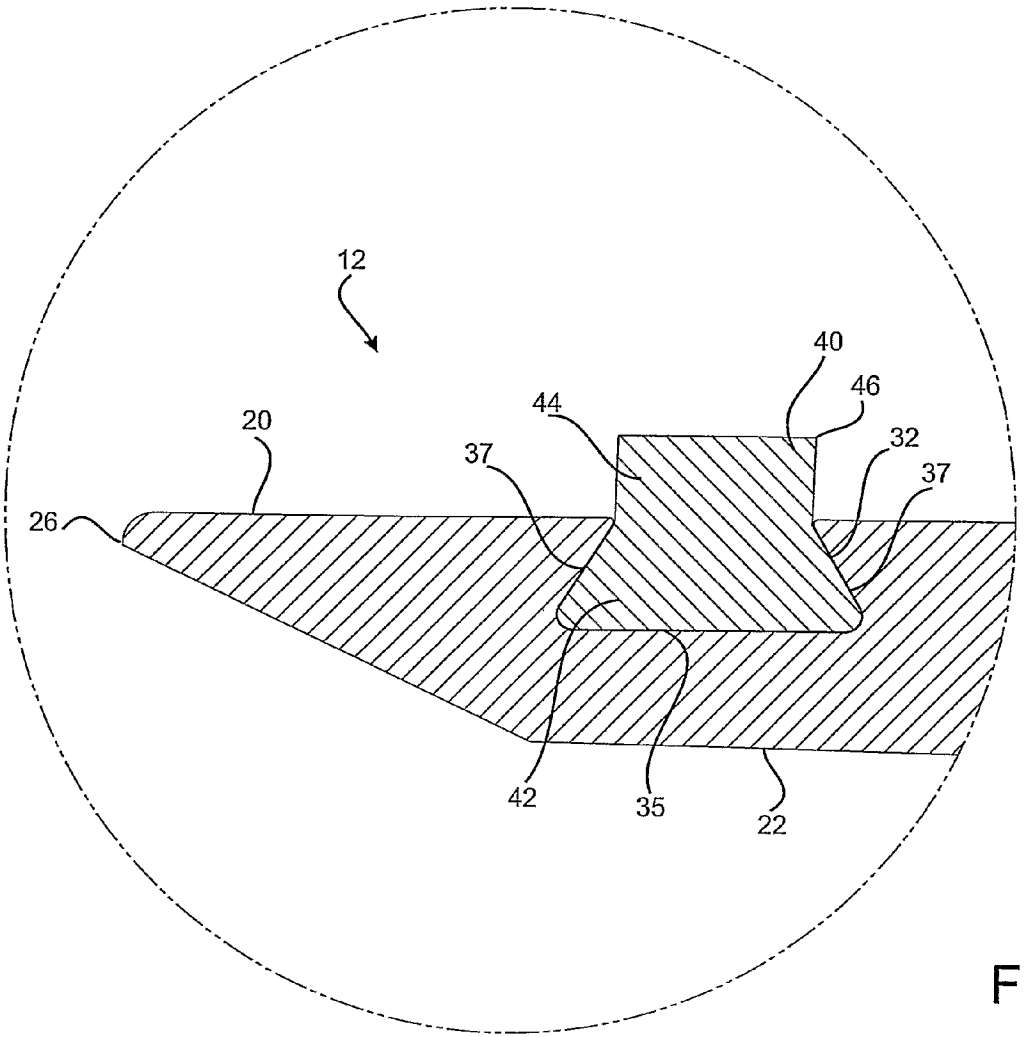
FIG. 6 is an enlarged view of a portion of the cross section shown in FIG. 5.

As can be best seen in FIG. 6, the low pressure face 22 tapers towards the high pressure face 20 of the blade 12 at the trailing edge 26. The channel 32 is located just inside this taper, within the full blade thickness. In the embodiment shown in the drawings the channel 32 is spaced about 15 mm from the trailing edge 26, with the channel having a thickness of about 5 mm.

In a preferred embodiment, as shown in the drawings, the channel 32 is in the shape of a 'dove-tail', as best seen in FIG. 6. The dove-tail has sides 37 oriented at about 60° to the surface of the high pressure face 20. The channel has a base 35 substantially parallel to the surface of the high pressure face 20. In the embodiment shown in the drawings, the channel 32 has a depth of about 3.4 mm, being about half the blade thickness.

The channel 32 includes an introducing region 38 at the first end, the introducing region 38 being substantially rectangular in cross section, and being wider than the remainder of the channel 32. The introducing region 38 is tapered in depth, from the surface of the high pressure face 20 to the depth of the remainder of the channel 32.

The channel 32 is arranged to receive an adjustment means in the form of a protruding strip 40. A suitable protruding strip 40 can be seen in cross section in FIG. 6.

The protruding strip 40 is elongate, and of substantially constant cross-sectional shape. It comprises an engaging portion 42 and an outwardly projecting portion 44.

The engaging portion 42 is complementary in shape to the channel 32. In the embodiment of the drawings this is a 'dove-tail' configuration, but it will be appreciated that other configurations may be used.

The outwardly projecting portion 44 extends away from the engaging portion 42 such that, when the engaging portion 42 is engaged within the channel 32, the outwardly projecting portion 44 juts outwardly from the high pressure face 20. In the arrangement of the drawings the outwardly projecting portion 44 is substantially perpendicular to the high pressure face 20.

The protruding strip 40 may be made of any suitable material. Possible materials include both nylon and polyurethane.

The protruding strip 40 may be engaged with the channel 32 by sliding engagement. The strip 40 is introduced into the channel 32 through the introducing region 38.

The effect of the engagement of the protruding strip 40 into the channel 32 is to alter the hydrodynamic properties of the blade 12 and thus the propeller 10. In particular, the engagement of strips 40 into each blade 12 has the effect of increasing the effective pitch of the propeller 10. Rather than water flowing over the propeller from the leading edge 24 to the trailing edge 26 in a substantially laminar fashion, the flow is instead from the leading edge 24 to an upper edge 46 of the outwardly projecting portion 44. This reduces the angle of water flow relative to the longitudinal direction of the hub 14, effectively increasing the pitch of the propeller 10.

It will be appreciated that the degree to which the effective pitch is altered is directly relative to the height of the outwardly projecting portion 44.

Trials have suggested that the effective pitch is varied by two mechanisms, the altering of pitch due to the change in angle between the leading edge 24 and the upper edge 46 as discussed above, and also the pressure concentration along a leading face of the outwardly projecting portion 44, causing a change in the direction of fluid flow. Testing of propellers similar to those described above and shown in the drawings has suggested that the latter effect may be represented by pitch change due to deflection ($P_D$) as a linear function of projecting portion height ($H_T$). The measured relationship in tests conducted by the applicant is $P_D(mm)=45+25.4(H_T-1)$. This relationship is consistent for results for projecting portions having $H_T$ between 0.5 mm and 4 mm.

As will be appreciated, this relationship suggests that the inclusion of a small projecting portion can still alter pitch by at least 20 mm.

The total change in effective pitch is equal to a superposition of the pitch caused by angular increase ($P_I$) and pitch change due to deflection ($P_D$). The effective pitch ($P_E(r)$mm) at a radius r (mm) is thus defined by $PE(r)=P_D+\tan(\alpha_P+\alpha_I)\,2\pi r$, where $\Delta_P$ is the pitch angle of the propeller without a strip 40, and $\alpha$, is the change in pitch angle. The total change in effective pitch over the blade can be obtained by averaging over a range of radii.

It will be understood that the length of the channel 32, and the location of its ends 34 and 36, will significantly affect the change in hydrodynamic properties caused by use of the strips 40. It is considered that having the curve at the second end 36 of the channel 32 increases the deflection effect caused by water pressure. It is also considered that having the lift generated by the portion of the blade close to the hub 14 is small, and therefore the position of the first end 34 of the channel may not be as significant.

In use, it is anticipated that a propeller 10 will be supplied with a plurality of sets of protruding strips 40, each set varying from another by the height of its projecting portions 44. In this way, the effective pitch can be chosen according to the conditions in which the propeller 10 is to operate.

The procedure for constructing a propeller begins by consideration of a desired mean pitch. When this has been determined, the above equation can be implemented to design a propeller having a nominal pitch less than the desired mean, but which achieves the desired mean with use of a strip having a projecting portion of, for instance, 1.5 mm.

Following casting of the propeller 10, an appropriate channel 32 can then be machined into each propeller blade 14. Following completion of the machining process, an initial strip 40 (with 1.5 mm height in this example) can be inserted into the channel 32.

Whilst the invention has been described with reference to the changing of pitch, it will be appreciated that suitable placement of the channel 32 may enable the invention to be used to vary other hydrodynamic properties of the blades 12. It may be possible, for instance, to employ the invention on the low pressure face 22 to reduce or control the onset of cavitation.

Modifications and variations as would be apparent to a skilled addressee are deemed to be within the scope of the present invention. For instance, although the projecting portion 44 has been described as extending substantially perpendicularly to the high pressure face 20, it will be appreciated that in some applications it may be desirable for the projecting portion 44 to make an acute or obtuse angle relative to the face from which it extends.

The invention claimed is:

1. A blade for a marine propeller, the blade including an attachment portion on a pressure face of the blade arranged to receive an adjustment means, whereby engagement of an adjustment means with the attachment portion alters the hydrodynamic properties of the blade, wherein the attachment portion is arranged to receive at least one of a selection of adjustment means of differing heights, each of the selection of adjustment means comprising a strip received by the attachment portion, the selected strip extending along at least a portion of the pressure face of the blade and inboard of the trailing edge of the blade, the selected strip having a protruding portion of selected height which extends, in use, from the pressure face of the blade and which selectively alters the hydrodynamic properties of the blade.

2. A blade for a marine propeller as claimed in claim 1, wherein the attachment portion comprises a channel within the blade.

3. A blade for a marine propeller as claimed in claim 2, the strip having an engaging portion receivable within the channel.

4. A blade for a marine propeller as claimed in claim 3, wherein the protruding portion has a width less than 10 mm.

5. A blade for a marine propeller as claimed in claim 4, wherein the protruding portion has a width of about 5 mm.

6. A blade for a marine propeller as claimed in claim 3, wherein the engaging portion is complementary in shape to the channel.

7. A blade for a marine propeller as claimed in claim 6, wherein the channel is dove-tailed in cross sectional shape.

8. A blade for a marine propeller as claimed in claim 2, wherein the channel is located on the high pressure face of the blade.

9. A blade for a marine propeller as claimed in claim 8, wherein the channel is located adjacent a trailing edge of the blade.

10. A blade for a marine propeller as claimed in claim 9, wherein the channel extends from about 30% of the blade radius to over 90% of the blade radius.

11. A blade for a marine propeller as claimed in claim 9, wherein the channel is spaced from the trailing edge by less than 50 mm.

12. A blade for a marine propeller as claimed in claim 11, wherein the channel is spaced from the trailing edge by less than 25 mm.

13. A blade for a marine propeller as claimed in claim 12, wherein the channel is spaced from the trailing edge by about 15 mm.

14. A blade for a marine propeller as claimed in claim 9, wherein the channel generally follow the contour of the trailing edge.

15. A blade for a marine propeller as claimed in claim 14, wherein the channel has a concave curve at an outer end thereof.

16. A blade for a marine propeller as claimed in claim 2, wherein the channel is located on the low pressure face of the blade.

17. A blade for a marine propeller as claimed in claim 2, wherein the channel includes an introducing region wider than the remainder of the channel.

18. A marine propeller having a plurality of blades as claimed in claim 1.

19. An adjustment means arranged to engage with a blade of a marine propeller, the adjustment means comprising a strip having an engaging portion arranged to be received by an elongate attachment portion of a pressure face of the blade, whereby engagement of the strip with the elongate attachment portion of the blade provides the selected strip extending along at least a portion of the pressure face of the blade and inboard of a trailing edge of the blade, and a portion of the strip projecting from the pressure face of the blade at selected height which alters the hydrodynamic pitch or cavitation properties of the blade a desired amount.

20. An adjustment means as claimed in claim 19, wherein the outwardly projecting portion is substantially perpendicular to a face of the blade from which it projects.

* * * * *